US006183125B1

(12) United States Patent
Hara et al.

(10) Patent No.: US 6,183,125 B1
(45) **Date of Patent: *Feb. 6, 2001**

(54) ELECTRONIC WATCH

(75) Inventors: Tatsuo Hara; Joji Kitahara, both of Nagano-ken (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/176,389

(22) Filed: Oct. 21, 1998

Related U.S. Application Data

(62) Division of application No. 08/817,995, filed on Jul. 21, 1997.

(51) Int. Cl.[7] ..... G04B 29/00
(52) U.S. Cl. ..... 368/322; 368/324
(58) Field of Search ..... 368/322–324, 368/325

(56) References Cited

FOREIGN PATENT DOCUMENTS

241959 * 8/1946 (CH) .
307689 * 8/1955 (CH) .
322331 * 7/1957 (CH) .
327798 * 3/1958 (CH) .

* cited by examiner

*Primary Examiner*—Bernard Roskoski
(74) *Attorney, Agent, or Firm*—Stroock & Stroock & Lavan LLP

(57) ABSTRACT

In an electronic watch including a so-called automatic winding dynamo, structures of parts themselves and layout of the parts are improved to achieve a reduction in thickness of the electronic watch. Bearing portions for a rotational shaft (211) of a dynamo rotor (21) are made up of hole jewels (212, 214) and ring-shaped caps (213, 215). The cap (215) covers, from the outer side, one end surface (216) of the hole jewel (214) which locates on the side facing a dynamo rotor (21), and defines a lubricant holding annular slot (G3) between the cap and an outer circumferential surface of the rotational shaft (211). Accordingly, even with the dynamo rotor (21) rotating at a high speed, a lubricant is prevented from scattering to the surroundings from the annular slot (G3). Spacings between adjacent parts can be narrowed and the thickness of the electronic watch can be reduced.

7 Claims, 11 Drawing Sheets

ELECTRONIC WATCH

This application is a divisional of application Ser. No. 08/817,995, filed Jul. 21, 1997, the contents of which are hereby incorporated by reference.

FIELD OF THE INVENTION

The present invention relates to an electronic watch including a so-called automatic winding dynamo, and more particularly to a technology for improving the structure of such an electronic watch to achieve a reduction in thickness.

BACKGROUND OF THE INVENTION

In a so-called electronic watch using a crystal oscillator or the like as a time base, as shown in FIG. 1, a power supply section 10 is made up of a small-sized dynamo 20 and a secondary power supply 30, and a stepping motor 40 is driven by power supplied from the power supply section 10. A watch wheel train 50 is operatively connected to a motor rotor 42 of the stepping motor 40 so that, for example, a second hand 161 attached to a second wheel 52 is intermittently rotated in steps of 6 for each second.

On the other hand, the small-sized dynamo 20 comprises a dynamo rotor 21 rotated by torque transmitted to it, a dynamo stator 22 disposed in surrounding relation to the dynamo rotor 21, and a dynamo coil 23 wound over a magnetic core 24 making up a magnetic circuit in cooperation with the dynamo stator 22 and the dynamo rotor 21. A dynamo wheel train 60 for transmitting rotation of an oscillating weight 25 while speeding up the rotation is operatively connected to the dynamo rotor 21.

In the field of electronic watches with hands, there is a strong demand for a reduction in thickness even in the above-mentioned type having a small-sized dynamo. However, such a demand for a reduction in thickness cannot be satisfied simply by reducing the size or thickness of various parts, e.g., the oscillating weight 25 as one component of the small-sized dynamo. For example, if the thickness of the oscillating weight 25 is reduced, weight unbalance of the oscillating weight 25 in the angular direction would be diminished and the oscillating-weight 25 would be hard to rotate at a high speed. Also, because necessary parts are mounted on a circuit board 31 constituting a circuit section, the circuit section cannot be further reduced in size and thickness. If it is nonetheless attempted to reduce a space in which the circuit section is installed, there would occur a risk that electronic parts and so forth may interfere with gears of the dynamo wheel train 60 and the watch wheel train 50.

A rotational shaft of the dynamo rotor 21 and a rotational shaft of the dynamo wheel train 60 are each often supported by a small and simple bearing formed of a hole jewel. In the bearing structure using a hole jewel, however, a lubricant applied to the rotational shaft tends to scatter to the surroundings upon rotation of the rotational shaft. If the scattered lubricant adheres to the watch wheel train 50, the lubricant may cause abnormal motion in driving the hands, such as stop or delay of any of gears, due to its viscosity. This raises a problem in conventional electronic watches with hands in that the parts cannot be arranged in closer relation and hence the thickness of the watch cannot be reduced.

Further, in the conventional electronic watches with hands, as shown in FIG. 11, one of the gears of the dynamo wheel train which tends to be easily subject to lateral pressure, such as a dynamo rotor transmitting wheel 62A (see FIG. 1), is sometimes supported at its rotational shaft 20A by a ball bearing 28A. The ball bearing 28A comprises a plurality of balls 281A arranged around the rotational shaft 620A of the dynamo rotor transmitting wheel 62A, a ring-shaped frame piece 282A holding the balls 281A, and a retainer piece 283A positioned adjacent the frame piece 282A to cooperate with it to prevent the balls 281A from slipping off. The balls 281A are held in contact with the rotational shaft 620A to restrict a lateral inclination of the rotational shaft 620A. Also, the rotational shaft 620A has a stepped portion 626A formed around it, and the stepped portion 626A abuts against the retainer piece 283A to restrict the position of the rotational shaft 620A in the axial direction.

However, the bearing structure shown in FIG. 11 has a problem that large friction resistance generates between the stepped portion 626A and the retainer piece 283A when the rotational shaft 620A is rotated. Generation of large friction resistance means that wasteful excessive force is required to rotate the rotational shaft 620A, and that the stepped portion 626A or the retainer piece 283A is severely worn away. Thus, there is a need for a novel bearing structure capable of solving the above-stated problems. However, even a bearing structure which has succeeded in solving the above-stated problems cannot be practically adopted if it requires a larger space, because such a bearing structure prevents a reduction in thickness of electronic watches with hands.

In view of the problems stated above, an object of the present invention is to provide a construction of an electronic watch with a built-in dynamo, which can improve structures of parts themselves arranged inside the watch and layout of the parts, and can reduce a total thickness of the electronic watch.

SUMMARY OF THE INVENTION

To achieve the above object, according to the present invention, an electronic watch having a base on which are mounted a dynamo including a dynamo wheel train for transmitting external force to a dynamo rotor, a secondary power supply for storing electric energy generated by the dynamo, a circuit section including a driving circuit supplied with power from the secondary power supply, a stepping motor driven by the driving circuit, and a watch wheel train for transmitting torque from the stepping motor to a time indicating member, is constructed as follows.

According to a first aspect of the present invention, at least one of a rotational shaft of the dynamo rotor and a rotational shaft of the dynamo wheel train is supported by a bearing portion comprised of a hole jewel portion supporting an axial end of the rotational shaft, and a ring-shaped cap portion covering one end surface of the hole jewel portion from the outer side to define a lubricant holding annular slot between the cap portion and an outer circumferential surface of the rotational shaft.

In the present invention, even under rotation of the rotational shaft, a lubricant applied to between the rotational shaft and the hole jewel portion is kept in the lubricant holding annular slot defined by the outer circumferential surface of the rotational shaft itself, the cap portion and the hole jewel, and is prevented from scattering to the surroundings. Accordingly, gaps between adjacent parts can be narrowed and the thickness of the electronic watch can be reduced.

In the present invention, preferably, the hole jewel portion and the cap portion make up a bearing portion for the rotational shaft of the dynamo rotor. The lubricant tends to scatter most easily from the bearing portion of the dynamo rotor which is rotated at a maximum speed in the watch wheel train and the dynamo wheel train. It is therefore preferred that the above bearing structure is provided for the rotational shaft of the dynamo rotor.

In the present invention, the hole jewel portion and the cap portion may be constructed by separate parts from each other. In this case, preferably, a gap is defined between the cap portion and the one end surface of the hole jewel portion covered by the cap portion. The presence of such a gap is advantageous in that when an assembly of the hole jewel portion and the cap portion fitted to each other is subject to surface treatment for preventing the lubricant from spilling out, a treatment solution can smoothly enter a space between the hole jewel portion and the cap portion, enabling the surface treatment to be reliably conducted all over the surfaces including the space between the hole jewel portion and the cap portion. Here, a size of the gap can be determined by the depth of the fit which results when the hole jewel portion is fitted into the cap portion.

In the present invention, the hole jewel portion and the cap portion may be constructed as one unitary part. Alternatively, the hole jewel portion and the cap portion may be constructed integrally with the base. With any of these structures, the number of parts can be cut down and hence the production cost can be reduced.

In the present invention, preferably, the rotational shaft supported by the hole jewel portion has a conical portion formed on an outer circumferential surface thereof near the axial end supported by the hole jewel portion such that a diameter of the rotational shaft increases gradually in the conical portion toward a portion of the rotational shaft where the lubricant holding annular slot is defined. With this structure, even if the lubricant spills and adheres onto the rotational shaft, the lubricant adhering onto the conical portion is forced to move toward a larger diameter end of the conical portion (i.e., toward the lubricant holding annular slot) under an influence of centrifugal force when the rotational shaft is rotated. As a result, the spilled lubricant is returned to the lubricant holding annular slot and is reliably prevented from scattering to the surroundings.

In the present invention, the rotational shaft supported by the hole jewel portion may have a step (looseness eliminating step) formed to project from an outer circumferential surface thereof and come into abutment against the one end surface of the hole jewel portion when the rotational shaft is axially moved toward the side where the rotational shaft is supported by the hole jewel portion. In this case, preferably, the position at which the step is formed on the outer circumferential surface of the rotational shaft is set so that the step is always located within the lubricant holding annular slot even when the rotational shaft is axially shifted in either direction. With this construction, even when the rotational shaft is axially shifted in either direction, the lubricant tending to scatter out of the lubricant holding annular slot is blocked by the step of the rotational shaft and hence scattering of the lubricant is reliably prevented.

In the present invention, generally, the hole jewel portion has a lubricant holding recess formed on the other end surface thereof opposite to the one end surface covered by the cap portion. In this case, preferably, the recess has an outer diameter larger than an outer diameter of the lubricant holding annular slot. This construction ensures that the amounts of the lubricant held by the lubricant holding annular slot and the lubricant injection recess, respectively, are balanced.

According to a second aspect of the present invention, preferably, at least one of a rotational shaft of the dynamo rotor and a rotational shaft of the dynamo wheel train is supported at an axial end thereof by a ball bearing of which balls abut against the rotational shaft in the radial direction to restrict a lateral inclination of the rotational shaft, and the balls of the ball bearing are held in abutment against a stepped portion formed at the axial end of the rotational shaft, thereby restricting the position of the rotational shaft in the axial direction. Here, the ball bearing may be arranged to support only one axial end of the rotational shaft, or each of both axial ends of the rotational shaft.

In the present invention, since the position of the rotational shaft is restricted in two directions by the balls themselves of the ball bearing, the rotational shaft can be supported through a rolling bearing in any of the two directions. This results in small friction resistance exerted on the rotational shaft during its rotation. Additionally, such a bearing structure is achieved just by partly improving a ball bearing structure, and hence its size remains small. As a result, the thickness of the electronic watch can be reduced.

In the present invention, preferably, the ball bearing supports a dynamo rotor transmitting wheel of the dynamo wheel train, the dynamo rotor transmitting wheel being operatively connected to an oscillating weight wheel which is rotated upon receiving external force. This structure is remarkably effective in reducing friction resistance of the dynamo rotor transmitting wheel which tends to receive lateral pressure and undergo maximum friction resistance.

In the present invention, the ball bearing may comprise a plurality of balls arranged around the rotational shaft and a ring-shaped frame for retaining the balls therein, and the balls are partly projecting out of a gap between an inner edge of one of opposite end surfaces of the ring-shaped frame on the side where the stepped portion is formed and the rotational shaft, so that the balls come into abutment against the stepped portion.

According to a third aspect of the present invention, the dynamo built in the electronic watch includes an oscillating weight for transmitting external force to the dynamo rotor through the dynamo wheel train. In this case, preferably, the oscillating weight comprises a rotating central portion supported by the base, a thinner wall portion formed around the rotating central portion, and a thicker wall portion formed around the thinner wall portion. The third aspect of the present invention is that the watch wheel train and the dynamo wheel train are arranged on the base in a rotating area of the thinner wall portion, and a part of the circuit section which is positioned in a rotating area of the thicker wall portion is arranged in a circuit part installation hole defined in the base in the form of a recess or a through-hole.

Note that the terms "the thinner wall portion" and "the thicker wall portion" used in the present invention mean portions where the thickness of the oscillating weight is relatively thin and thick, respectively, and should not be construed as meaning the thinnest and thickest portions of the oscillating weight in a limited sense.

In the electronic watch of the present invention, the oscillating weight is constructed of the thinner wall portion and the thicker wall portion to increase weight unbalance of the oscillating weight, and necessary members are arranged, in an optimum state, separate in the respective rotating areas of the thinner wall portion and the thicker wall portion of the oscillating weight. Specifically, the part of the circuit section which is positioned in the rotating area of the thicker wall portion is arranged in the circuit part installation hole defined in the base in the form of a recess or a through-hole. With the present invention, therefore, a narrow gap defined in the rotating area of the thicker wall portion can also be utilized effectively and hence the thickness of the electronic watch can be reduced.

In the present invention, the part of the circuit section which is arranged in the circuit part installation holes in the rotating area of the thicker wall portion is an electronic part making up the driving circuit.

In the present invention, generally, a wheel train setting lever operatively connected to a setting lever is arranged on the base in the rotating area of the thinner wall portion, the wheel train setting lever stopping motion of the watch wheel train when the setting lever is operated upon by an external operation applied to an external operating member. In this case, as the part of the circuit section which is arranged in the circuit part installation hole in the rotating area of the thicker wall portion, a reset lever operatively connected to the setting lever and serving as a switch for temporarily stopping and restarting rotation of the stepping motor may be arranged in the circuit part installation hole.

In the present invention, the base may comprise a metallic main plate and a circuit support seat made of insulating material. In this case, preferably, the circuit part installation hole is formed in the circuit support seat.

In the present invention, a screw fastening portion of an oscillating weight support for supporting the oscillating weight and the dynamo wheel train through respective bearings may be disposed on the base in the rotating area of the thinner wall portion. In this case, preferably, the oscillating weight support is entirely disposed on the base in the rotating area of the thinner wall portion.

In any aspect of the present invention, generally, the watch wheel train includes a hour wheel coupled to an hour hand. In this case, preferably, the hour wheel has opposite end surfaces machined such that one end surface on the side where the hour hand is located is cut to hollow slightly in an inner peripheral portion thereof, and the other end surface on the opposite side is cut to hollow slightly in an outer peripheral portion thereof. By thus recessing the one end surface of the hour wheel and interposing a conical plate spring between the hour wheel and the rear surface of a dial, a necessary minimum gap can be maintained between the hour wheel and the dial. Accordingly, the thickness of the electronic watch can be reduced. Further, even if burrs occur in the step of drilling the dial, the burrs are prevented from contacting the hour wheel because of the presence of the necessary minimum gap. Therefore, notwithstanding the reduction in thickness of the electronic watch, rotation of the hour wheel will never be impeded.

In any aspect of the present invention, preferably, a wall for preventing scattering of a lubricant is formed between the watch wheel train and the dynamo wheel train by a portion of a wheel train bridge supporting the watch wheel train. With this structure, the lubricant is prevented from scattering to the surroundings because the wall formed by a portion of the wheel train bridge is present near the dynamo rotor transmitting wheel of the dynamo. It is thus possible to narrow gaps between adjacent parts and correspondingly secure a space for installation of the parts. Accordingly, the thickness of the electronic watch can be reduced. Further, since rotation of gears will never be impeded by the lubricant scattering to the watch wheel train, reliability is improved.

In any aspect of the present invention, preferably, a connecting portion between the dynamo stator and a dynamo magnetic core of the dynamo has a sectional structure that a main plate, the dynamo magnetic core and the dynamo stator are layered one above another in the order named, that a joint portion of the dynamo stator with the dynamo magnetic core has upper and lower surfaces which are both positioned between upper and lower surfaces of the dynamo stator arranged in surrounding relation to the dynamo rotor, and that the upper surface of the joint portion is positioned at a lower level than an upper surface of a magnet of the dynamo rotor. By constructing the connecting portion between the dynamo stator and the magnetic core such that the joint portion of the dynamo stator overlies one layer piece of the magnetic core, the connecting portion can be kept thin and the thickness of the electronic watch can be reduced.

[Reference Numerals]

Figure 1:
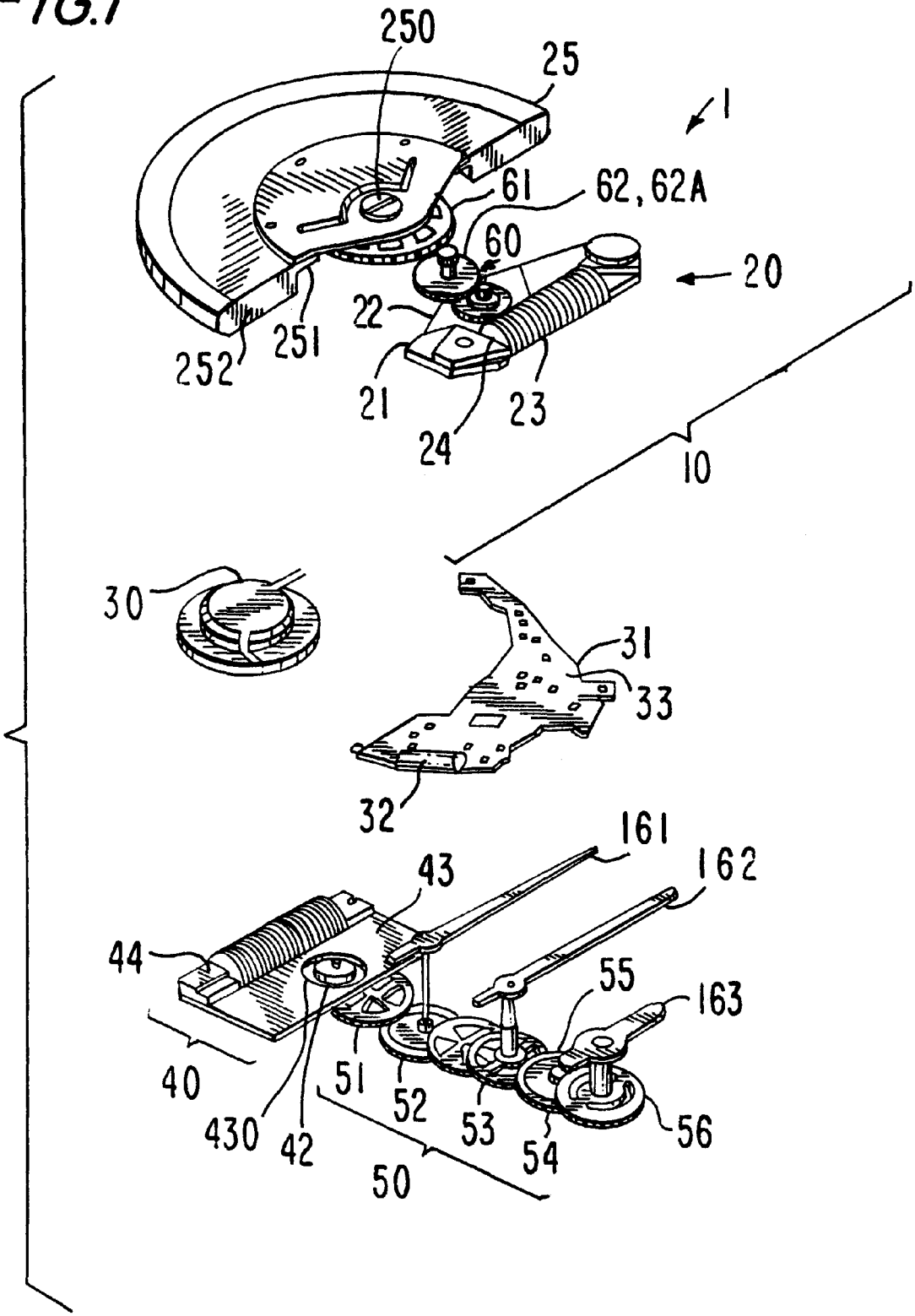
FIG. 1 is a schematic exploded view showing the general construction of an electronic watch with hands.

1 . . . electronic watch with hands
2 . . . base
20 . . . small-sized dynamo
21 . . . dynamo rotor

22 . . . dynamo stator
23 . . . dynamo coil
24 . . . magnetic core
25 . . . oscillating weight
26 . . . oscillating weight support
27, 28 . . . ball bearings
30 . . . secondary power supply
31 . . . circuit board
40 . . . stepping motor
41 . . . motor coil
42 . . . motor rotor
43 . . . motor stator
50 . . . watch wheel train
56 . . . hour wheel
60 . . . dynamo wheel train
62 . . . dynamo rotor transmitting wheel
74 . . . wheel train setting lever
75 . . . reset lever
80 . . . wheel train bridge
200 . . . main plate
205 . . . through-hole of circuit support seat (circuit part installation hole)
207 . . . recess of circuit support seat (circuit part installation hole)
211 . . . rotational shaft of dynamo rotor
212, 214 . . . hole jewels
213, 215 . . . caps
211 . . . rotational shaft
217 . . . conical portion
218 . . . looseness eliminating step
219 . . . fitting depth determining boss
222 . . . gap between end surface of hole jewel and cap
251 . . . thinner wall portion of oscillating weight
252 . . . thicker wall portion of oscillating weight
303 . . . conical plate spring
280 . . . frame
281 . . . ball
282 . . . frame piece
283 . . . retainer piece
311 . . . circuit support seat
620 . . . rotational shaft of dynamo rotor transmitting wheel
G1 . . . lubricant holding gap
G2 . . . gap between hour wheel and dial
G3 . . . lubricant holding annular slot

DESCRIPTION OF THE PREFERRED EMBODIMENTS

An embodiment of the present invention will be described hereunder with reference to the drawings.

(General Construction)

FIG. 1 is a schematic exploded view showing the general construction of an electronic watch. A basic structure of the electronic watch of this embodiment is similar to that of a conventional electronic watch. Therefore, components having functions common to the electronic watch of this embodiment and the conventional electronic watch are denoted by the same reference numerals in the following description.

In FIG. 1, an electronic watch 1 with hands of this embodiment is an analog quartz wrist watch of type indicating the time of day by the hands. A stepping motor 40 is driven in accordance with a signal output from a crystal oscillator 32 mounted on a circuit board 31. The stepping motor 40 comprises a motor rotor 42 having a permanent magnet magnetized into two poles, a motor stator 43 having a cylindrical rotor installation hole 430 in which the motor rotor 42 is disposed, and a coil block formed by winding a coil 41 over a magnetic core 44. A watch wheel train 50 comprised of a fifth wheel 51, a second wheel 52, a third wheel 53, a center wheel 54, a minute wheel 55 and a hour wheel 56 is operatively connected to the motor rotor 42 through respective pinions. A second hand 161 is fixed to the distal end of a shaft of the second wheel 52 of the watch wheel train. A minute hand 162 is fixed to the distal end of a cylindrical shaft of the center wheel 54. An hour hand 163 is fixed to the distal end of a cylindrical shaft of the hour wheel 56. Here, a speed reducing ratio achieved through the gearing from the motor rotor 42 to the second wheel 52 is set to 1/30. The second hand 161 is constructed such that it is intermittently rotated in steps of 6 whenever the motor rotor 42 is intermittently rotated in steps of 180 for each second.

A power supply section 10 for driving the stepping motor 40 is primarily made up of a small-sized dynamo 20 and a secondary power supply 30 (capacitor). In order to generate power upon movement of the user's wrist over which the electronic watch 1 with hands is fitted, the small-sized dynamo 20 comprises an eccentric oscillating weight 25 rotatable in response to the wrist movement, a dynamo rotor 21 rotated by receiving kinetic energy from the oscillating weight 25, a dynamo stator 22 disposed in surrounding relation to the dynamo rotor 21, and a dynamo coil 23 wound over a magnetic core 24 making up a magnetic circuit in cooperation with the dynamo stator 22 and the dynamo rotor 21. The oscillating weight 25 and the dynamo rotor 21 are operatively interconnected through a dynamo wheel train 60 for transmitting rotation of the oscillating weight 25 while speeding up the rotation. The dynamo wheel train 60 is made up of a oscillating weight wheel 61 formed integrally with the oscillating weight 25, and a dynamo rotor transmitting wheel 62 having a pinion held in mesh with the oscillating weight wheel 61. The dynamo rotor 21 has a permanent magnet magnetized to have N and S poles which are rotated when the rotation of the oscillating weight 25 is transmitted to the dynamo rotor 21. Accordingly, induced electromotive force can be taken out of the dynamo coil 23 and charged into the secondary power supply 30.

The oscillating weight 25 has, though described later in more detail, a oscillating weight fixing screw 250 attached to its rotating central portion. The oscillating weight 25 is formed such that its inner peripheral portion around the oscillating weight fixing screw 250 (rotating central portion) provides a thinner wall portion 251 as a light oscillating weight, and its outer peripheral portion provides a thicker wall portion 252 as a heavy oscillating weight stretching radially outward from the light oscillating weight. As a result, in spite of a reduction in thickness of the oscillating weight 25, weight unbalance of the oscillating weight 25 in the angular direction remains large.

(Plan Layout of Wheel Train)

Figure 2:
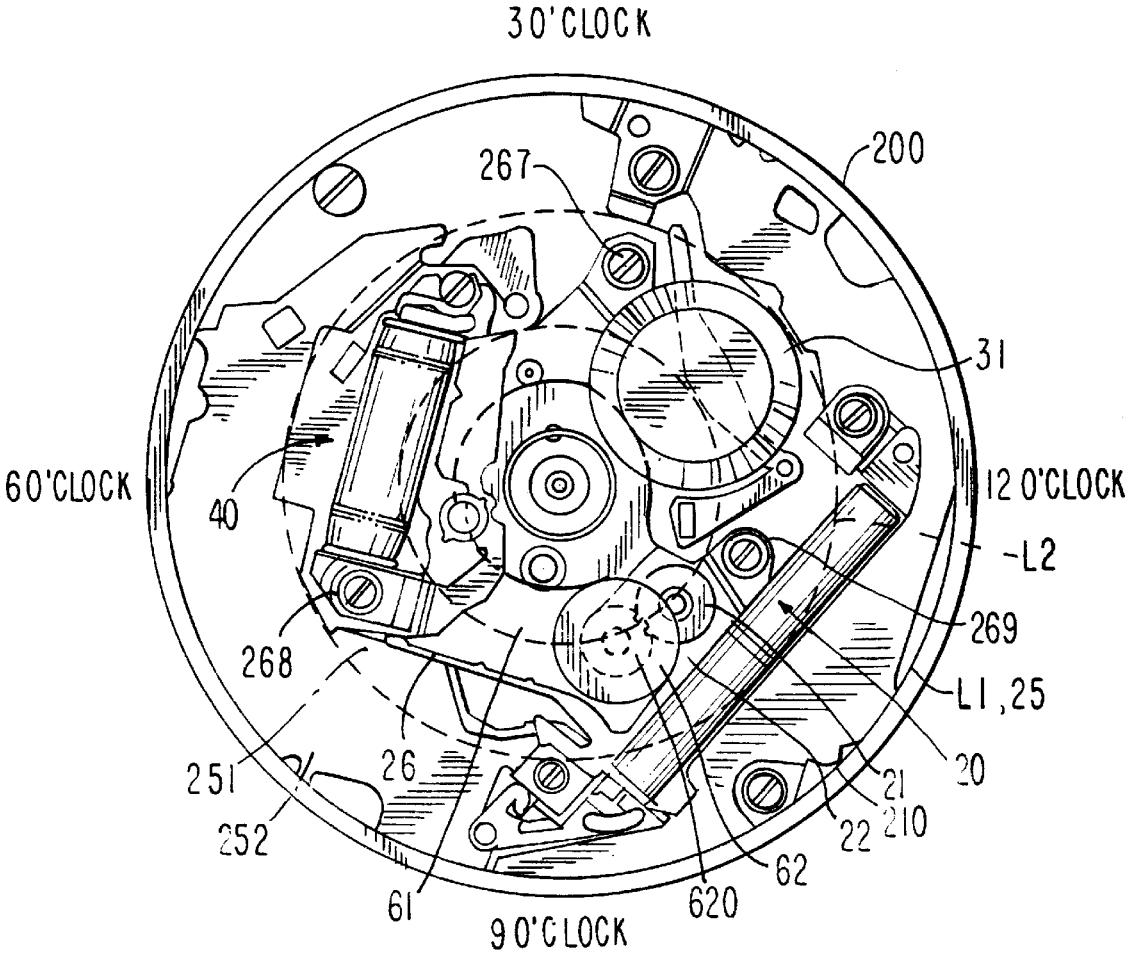
FIG. 2 is an explanatory view showing the layout, as viewed from above, of a small-sized dynamo and other parts in the electronic watch with hands according to an embodiment of the present invention.
Figure 3:
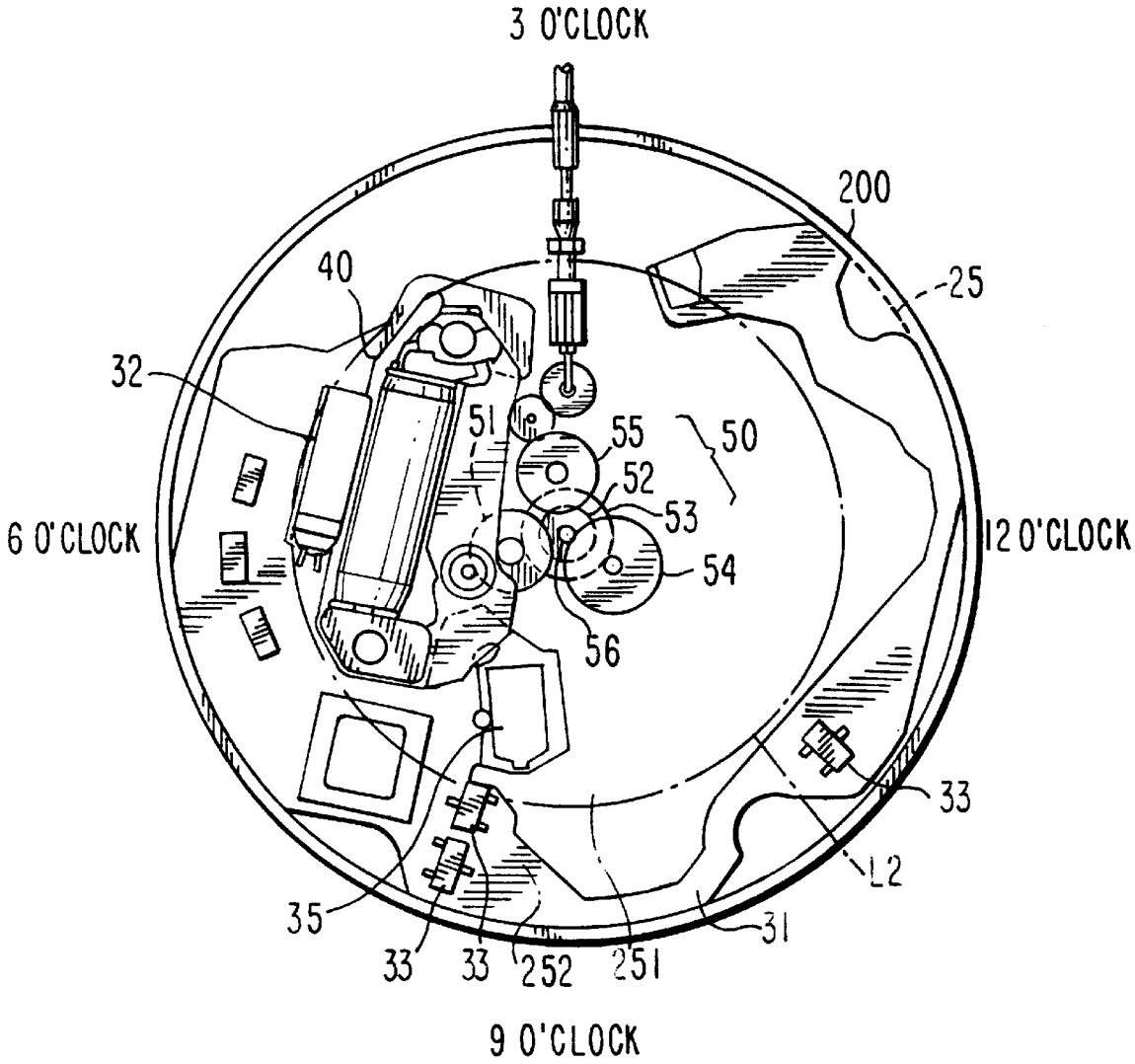
FIG. 3 is an explanatory view showing the layout, as viewed from above, of a stepping motor, a watch wheel train, a circuit board, etc. in the electronic watch with hands according to the embodiment of the present invention.

The layout of various parts for developing a power generating function and a hand driving function will be described with reference to FIGS. 2 and 3. FIG. 2 is an explanatory view showing the layout, as viewed from above, of the small-sized dynamo and other parts in the electronic watch with hands of this embodiment, and FIG. 3 is an explanatory view showing the layout, as viewed from above, of the stepping motor, the watch wheel train, the circuit board, etc. in the electronic watch with hands. FIG. 2 is a plan view showing a state where principal parts are mounted on a main plate constituting a base in the electronic watch with hands of this embodiment.

Referring to FIG. 2, a central portion of a main plate 200 serves as the center of rotation of the oscillating weight 25 and the hands. A dial of the watch is disposed on the rear side of the main plate 200, and the time of day is indicated on the drawing at corresponding angular positions of the main plate 200.

In FIG. 2, a rotating area of the oscillating weight 25 is indicated by a two-dot-chain line L1 positioned slightly inward of an outer peripheral edge of the main plate 200. Inside the two-dot-chain line L1, there is indicated another two-dot-chain line L2 representing a boundary between a rotating area of the thinner wall portion 251 of the oscillating weight 25 and a rotating area of the thicker wall portion 252 thereof.

In this embodiment, the small-sized dynamo 20 is arranged in the rotating area of the oscillating weight 25 so as to extend over both the rotating area of the thinner wall portion 251 and the rotating area of the thicker wall portion 252. The dynamo rotor transmitting wheel 62 is meshed with a pinion 210 of the motor rotor 21, and the oscillating weight wheel 61 fixed to the oscillating weight 25 is meshed with a pinion 620 of the dynamo rotor transmitting wheel 62. Here, the dynamo rotor transmitting wheel 22, the motor rotor 21, etc., as well as the oscillating weight wheel 61, which are parts of the dynamo wheel train 60 having relatively large height, are all arranged in the rotating area of the thinner wall portion 251.

The oscillating weight 25 and the dynamo wheel train 60 are both supported by a oscillating weight support 26 in the form of a flat plate. The oscillating weight support 26 is also entirely disposed in the rotating area of the thinner wall portion 251. Further, the oscillating weight support 26 is fixed to the main plate 200 by three screws 267, 268, 269 any of which is positioned in the rotating area of the thinner wall portion 251.

As a result of thus effectively utilizing a space in the rotating area of the thinner wall portion 251, the thickness of the electronic watch 1 with hands can be reduced. In addition, the electronic watch 1 can be easily disassembled because the oscillating weight support 26 can be removed in its entirety if the oscillating weight 25 is removed.

Within the rotating area of the thinner wall portion 251, as shown in FIG. 3, there is further disposed the watch wheel train 50 comprised of the fifth wheel 51, the second wheel 52, the third wheel 53, the center wheel 54, the minute wheel 55 and the hour wheel 56 which have each a relatively large height.

Accordingly, even with the structure that the thicker wall portion 252 is provided as the heavy oscillating weight in the outer peripheral portion of the oscillating weight 25 for the purpose of increasing weight unbalance of the oscillating weight 25 in the angular direction, no trouble occurs in arrangement of the train wheels. Further, an area of the thinner wall portion 251 can be enlarged corresponding to increased weight unbalance of the oscillating weight 25, thereby securing a larger space for arrangement of the other parts. Thus, the above structure is advantageous in achieving a reduction in thickness of the electronic watch 1 with hands.

(Plan Layout of Circuit Board)

On the contrary, relatively thin members are arranged in the rotating area of the thicker wall portion 252 of the oscillating weight 25. First, since the circuit board 31 formed of a flexible board, on which diodes 33, etc. making up a driving circuit are mounted, is relatively thin, it is arranged in the rotating area of the thicker wall portion 252 of the oscillating weight 25 by utilizing a gap between the thicker wall portion 252 of the oscillating weight 25 and the main plate 200.

Figure 4:
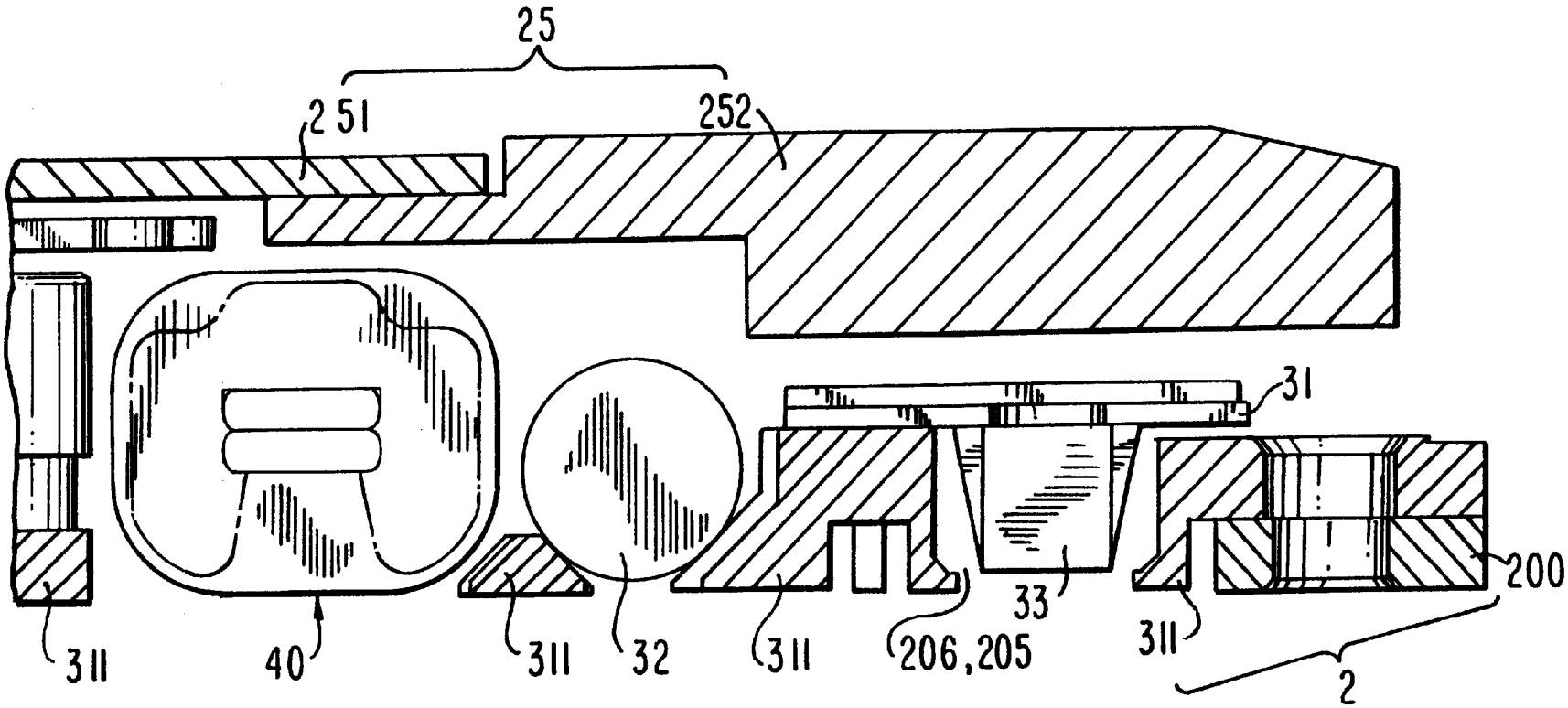
FIG. 4 is a vertical sectional view showing the positional relationship between the circuit board and a oscillating weight in the electronic watch with hands according to the embodiment of the present invention.

As shown in FIGS. 3 and 4, however, since a crystal oscillator 32 and an IC driving capacitor 35 require a relatively large dimension for installation thereof, these parts are arranged laterally of the circuit board (in the rotating area of the thinner wall portion 251 of the oscillating weight 25), while they are connected to the circuit board 31 through wires.

Aside from those parts, surface-mounted parts such as the diodes 33 are mounted on the circuit board 31, and the circuit board 31 is arranged such that the diodes 33, etc. face the main plate 200. In other words, the diodes 33, etc. are disposed in respective through-holes 206 formed in the main plate 200. A circuit support seat 311 made of insulating material is fitted to inner peripheral surfaces of the through-holes 206 in the main plate 200, and the diodes 33, etc. are positioned in respective through-holes 205 (circuit part installation holes) formed in the circuit support seat 311.

Thus, of the main plate 200 and the circuit support seat 311 jointly constituting the base 2, the circuit support seat 311 is utilized to receive the diodes 33, etc. in the through-holes 205. Therefore, more than half of electronic parts mounted on the circuit board 31 and making up the driving circuit can be arranged in the rotating area of the thicker wall portion 252 where the gap size between the oscillating weight and main plate is small. In addition, since those electronic parts are surrounded by the insulating circuit support seat 311 fitted to the inner peripheral surfaces of the through-holes 206 in the main plate 200, a trouble such as a short-circuit is surely prevented.

(Layout of Changeover Members for Adjusting Time of Day)

Figure 5:
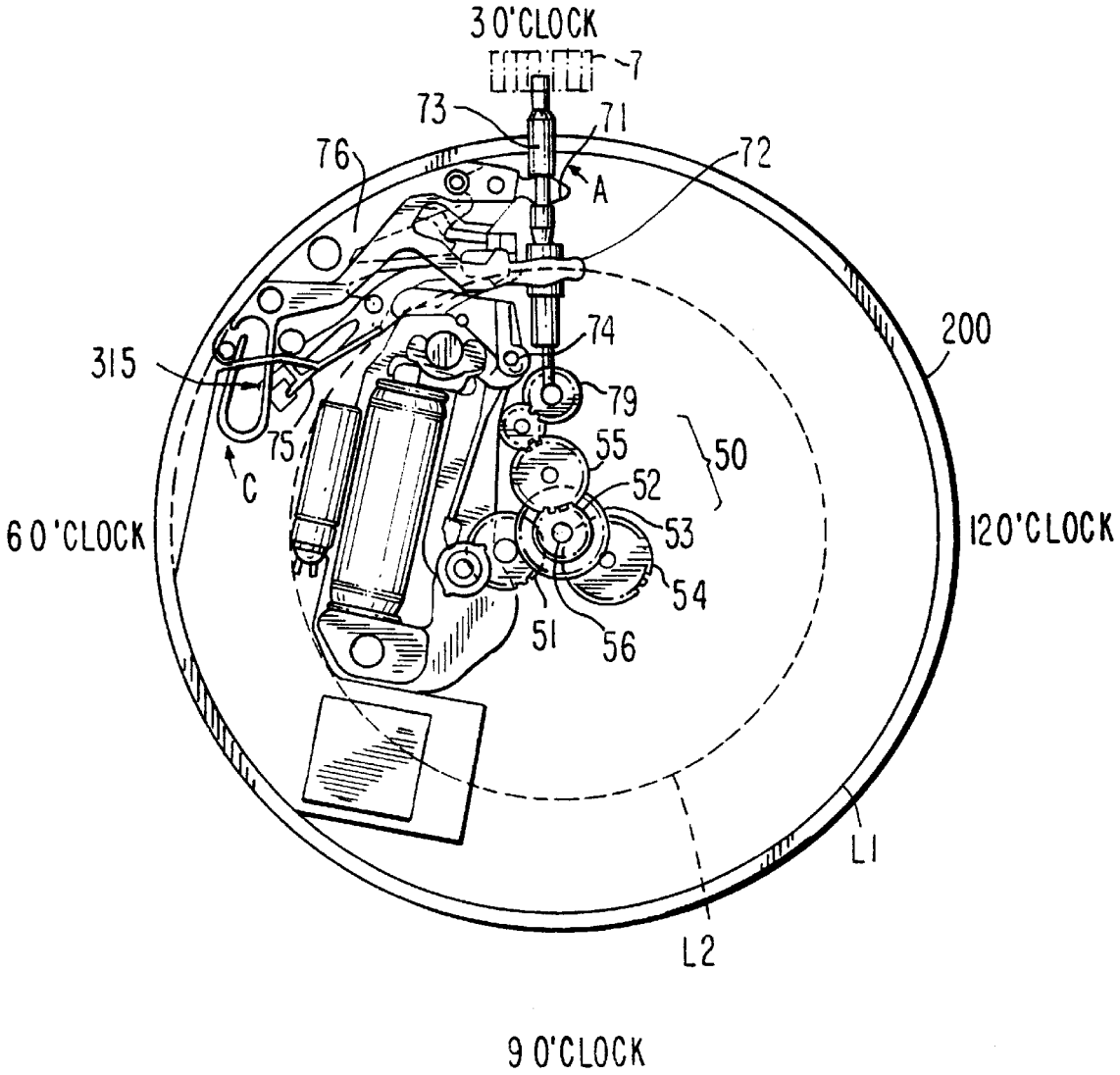
FIG. 5 is an explanatory view showing the positional relationship, as viewed from above, between parts of a mechanism for adjusting the indicated time of day in the electronic watch with hands according to the embodiment of the present invention.

FIG. 5 is an explanatory view showing the positional relationship, as viewed from above, between parts of a mechanism for adjusting the indicated time of day in the electronic watch with hands according to the embodiment.

As shown in FIG. 5, the electronic watch 1 with hands also includes a mechanism for adjusting the second hand, etc. by the user operating a crown 7 (external operating member) from the outside. This mechanism is constructed as follows. A setting lever 71 engages with a shaft coupled to the crown 7, and the position of the setting lever 71 is restricted by a yoke holder 76. A yoke 72 engages in a groove of a sliding pinion 73 which is coupled to the shaft of the crown 7. Therefore, when the crown 7 is pulled outward one step, the setting lever 71 is rotated in the direction of arrow A. Here, a dowel formed on the setting lever 71 engages in a cam slot of a train wheel setting lever 74. Accordingly, in response to the crown 7 being pulled outward, the train wheel setting lever 74 is rotated in the direction of arrow B to engage with the fifth wheel 51, thereby stopping motion of the second hand 161. By turning the crown 7 about its axis in such a condition, the minute wheel 55 and so forth can be rotated through a setting wheel 79. The provision of that mechanism enables the hands to be adjusted for the correct time of day while the second hand 161 is kept stopped, so that the indicated time of day can be adjusted even in a unit of second.

Further, a reset lever 75 is also connected to the setting lever 71 through a cam mechanism. When the crown 7 is pulled outward one step, the reset lever 75 is rotated in the direction of arrow C. A contact portion 315 extending from the circuit board 31 is positioned on the side toward which the reset lever 75 is rotated. In interlock with the pulling-out of the crown 7 in one step, therefore, the contact portion 315 is pushed by the reset lever 75 to actuate a switch. In this state, output of a driving signal to the stepping motor 40 from the driving circuit (not shown) constructed on the circuit board 31 is stopped and the motor rotor 42 also stops its rotation.

Figure 6:
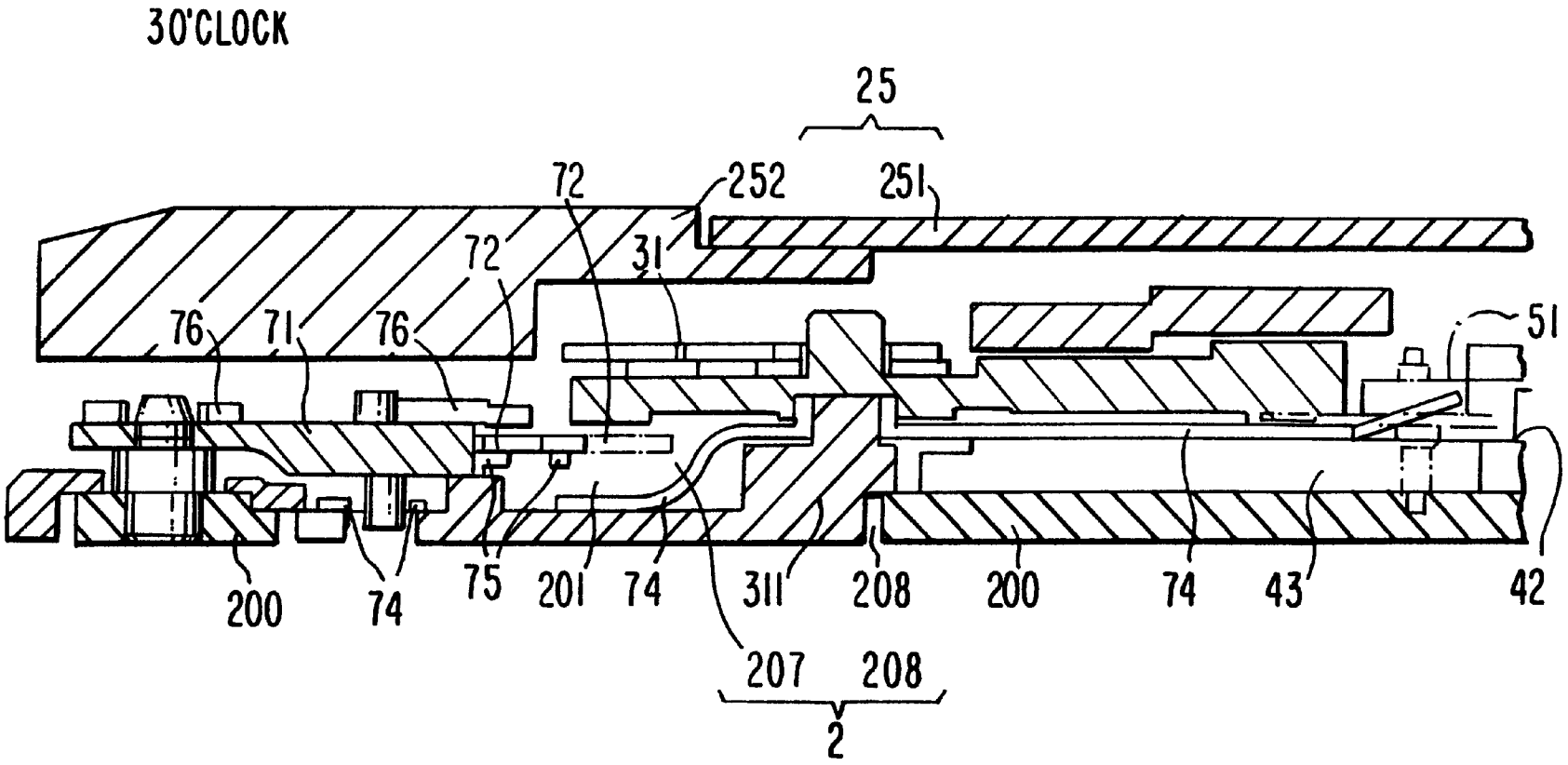
FIG. 6 is a vertical sectional view showing the positional relationship between the parts of the mechanism for adjusting the indicated time of day in the electronic watch with hands according to the embodiment of the present invention.

Here, as will be seen from FIG. 6, the reset lever 75 and the train wheel setting lever 74 are each formed of a relatively thin plate member. Of these two levers, the train wheel setting lever 74 acts directly on the fifth gear 51 and therefore it is required to locate in a central portion of the main plate 200. Thus, the train wheel setting lever 74 is disposed in the rotating area of the thinner wall portion 251 of the oscillating weight 25 (i.e., between the rotating level of the thinner wall portion 251 of the oscillating weight 25 and the main plate 200).

On the other hand, the reset lever 75 is formed of a thin metallic plate and is just required to position in such a manner as able to contact part of the circuit board 31. Accordingly, the reset lever 75 is arranged in the rotating area of the thicker wall portion 252 of the oscillating weight 25 (i.e., between the rotating level of the thicker wall portion 252 of the oscillating weight 25 and the main plate 200).

The reset lever 75 formed of a metallic plate also constitutes part of the circuit section. Further, the reset lever 75 is arranged close to the main plate 200 as with the diodes 33 on the circuit board 31 which have been described above in connection with FIG. 4. Specifically, in this embodiment, the reset lever 75 is arranged in a recess 207 (circuit part installation hole) of the insulating circuit support seat 311 which is fitted to a through-hole 208 of the main plate 200.

Thus, in this embodiment, of the main plate 200 and the circuit support seat 311 jointly constituting the base 2, the circuit support seat 311 is utilized to receive the reset lever 75 in the circuit part installation hole defined by the recess 207. Therefore, the reset lever 75 can be arranged in the rotating area of the thicker wall portion 252 where the gap size between the oscillating weight and main plate is small. In addition, since the reset lever 75 is surrounded by the insulating circuit support seat 311, a trouble such as a short-circuit is surely prevented.

Further, changeover members such as the setting lever 71 and the yoke 72 are firmly held down by the yoke holder 76 in the rotating area of the thicker wall portion 252 of the oscillating weight 25 (i.e., between the rotating level of the thicker wall portion 252 of the oscillating weight 25 and the main plate 200).

As described above, the thickness of the electronic watch 1 with hands of this embodiment is reduced by sufficiently utilizing not only the rotating area of the thinner wall portion 251 of the oscillating weight 25, but also the narrow gap between the thicker wall portion 252 of the oscillating weight 25 and the main plate 200.

Figure 7A:
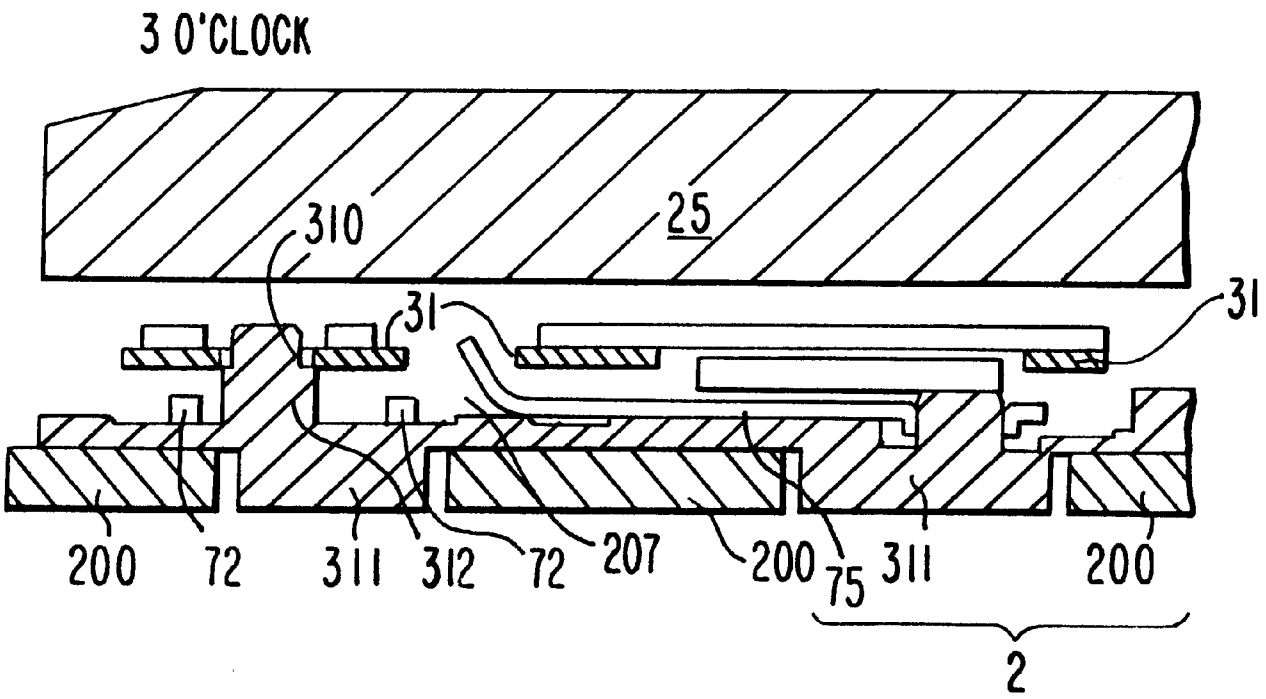
FIG. 7(*a*) is a vertical sectional view of a mechanism section for adjusting the indicated time of day in the electronic watch with hands according to the embodiment of the present invention, the mechanism section being cut in the radial section, and FIG. 7(*b*) is a side sectional view of the mechanism section.
Figure 7B:
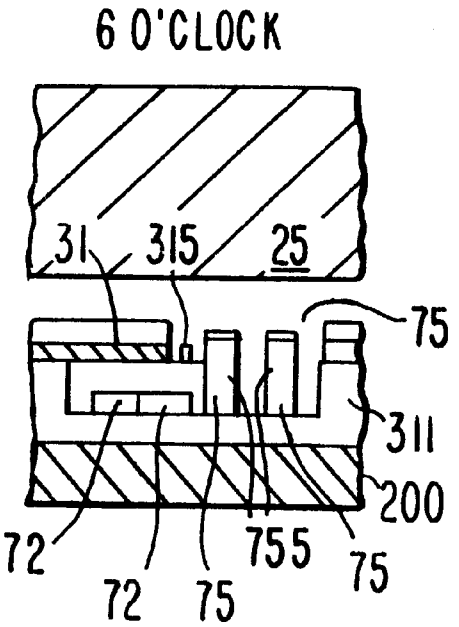

Additionally, as will be seen from FIG. 7(*a*), the circuit board 31 is positioned by fitting a hole 310 formed in the circuit board 31 over a corresponding projection 312 on the circuit support seat 311, and it is simultaneously firmly held down by a circuit retainer plate 310. Also, as will be seen from FIG. 7(*b*), a portion of the end of the circuit board 31 is laterally extended to provide a contact 315. When a contact counterpart 755 formed by bending a tip of the reset lever 75 is moved laterally from a base position (state where the crown 7 is pushed in/0th step) upon the pulling-out of crown 7 (i.e., when the crown 7 is pulled out one step), the contact counterpart 755 of the reset lever 75 is brought into contact with the contact 315 of the circuit board 31. Conversely, when the crown 7 is pushed in from the pulled-out state, the contact 315 and the contact counterpart 755 are separated from each other, whereupon the driving signal from the driving circuit is allowed to be output to the stepping motor 40. This causes the motor rotor 42 to start rotation again. Further, the pushing-in of the crown 7 makes the train wheel setting lever 74 separate from the fifth wheel 51, allowing the second hand 161 to resume rotation.

(Structure of Wheel Train and Bearing Portion for Same)

Figure 8:
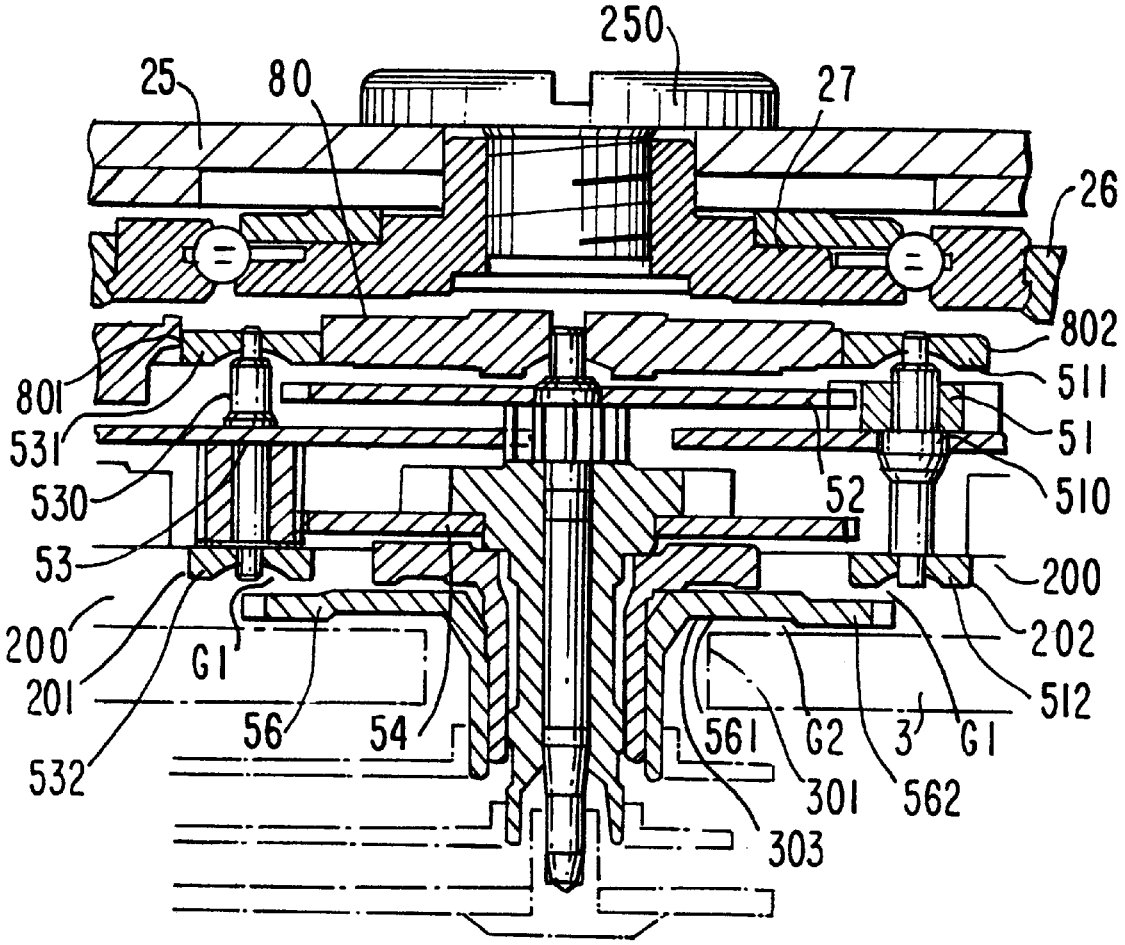
FIG. 8 is a vertical sectional view of the watch wheel train and thereabout assembled in the electronic watch with hands according to the embodiment of the present invention.
Figure 9A:
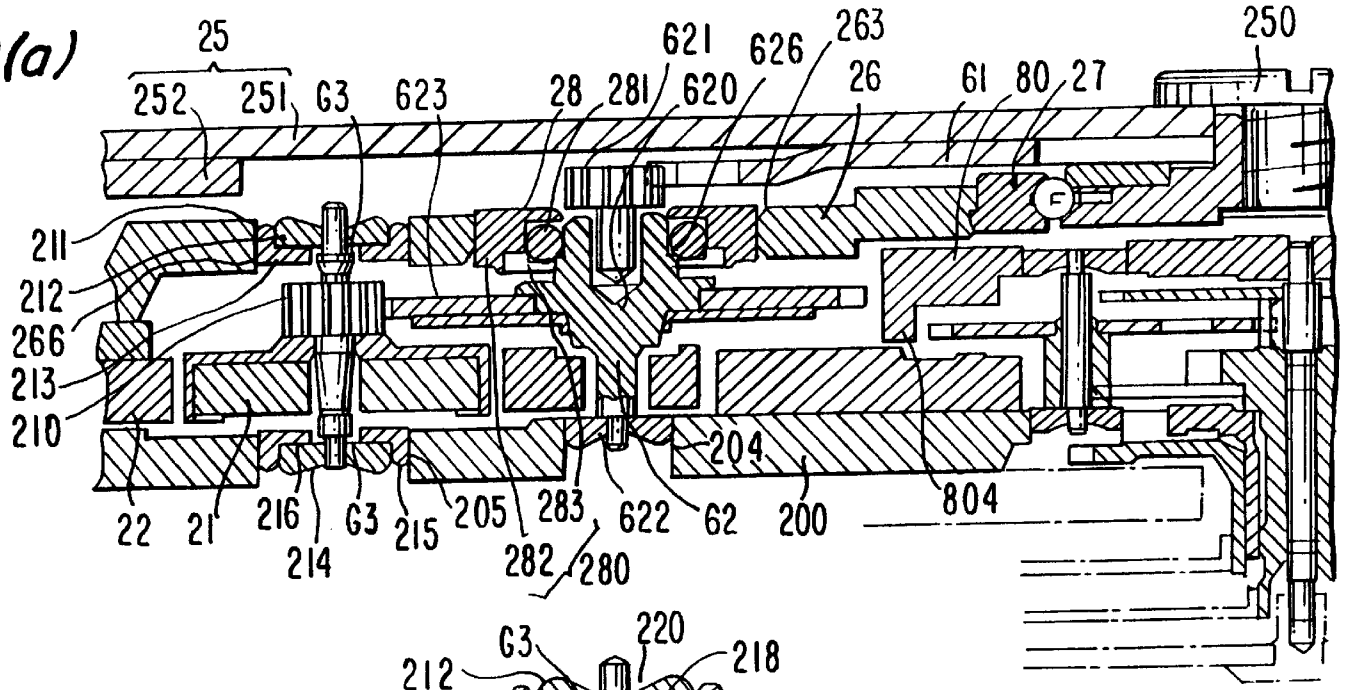
FIG. 9(A) is a vertical sectional view of a dynamo wheel train and thereabout assembled in the electronic watch with hands according to the embodiment of the present invention.
Figure 9B:
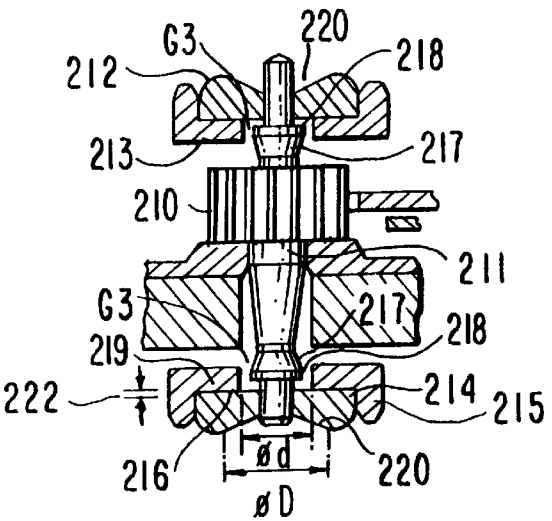
FIG. 9(B) is an enlarged view of a bearing portion supporting a rotational shaft of a dynamo rotor.
Figure 10:
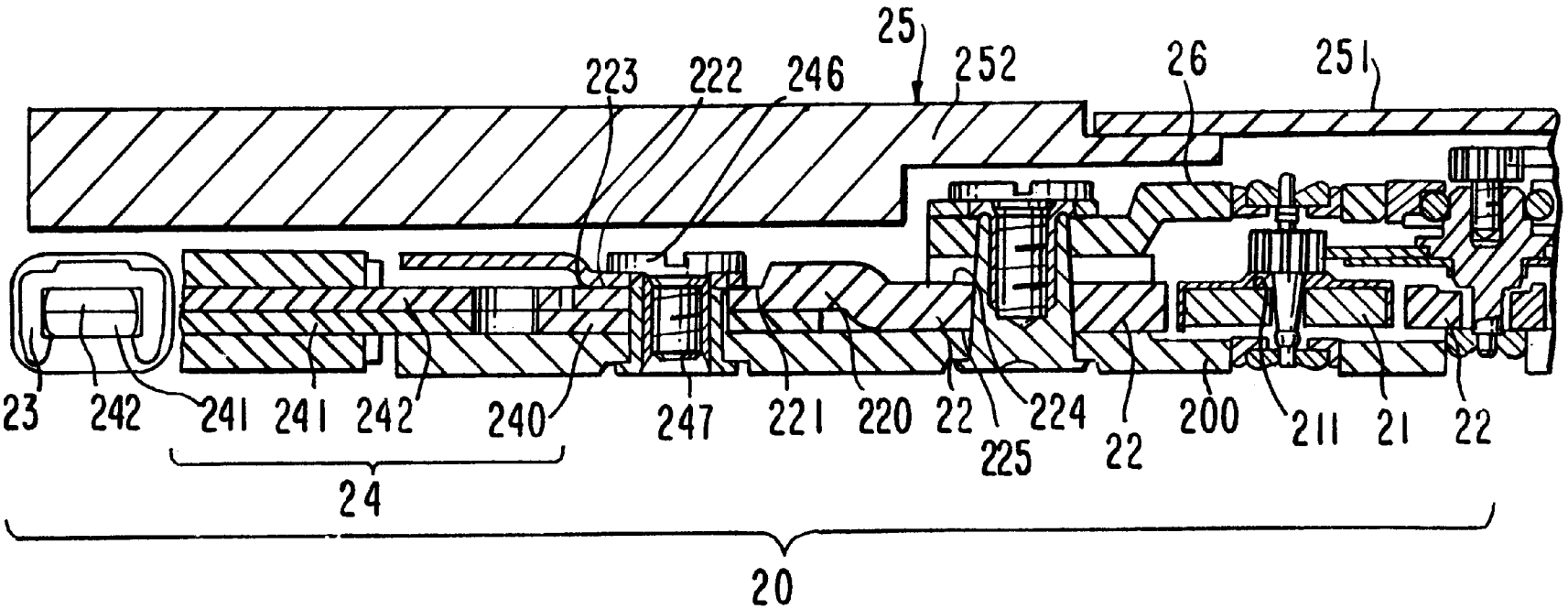
FIG. 10 is a vertical sectional view of the small-sized dynamo and thereabout assembled in the electronic watch with hands according to the embodiment of the present invention.
Figure 11:
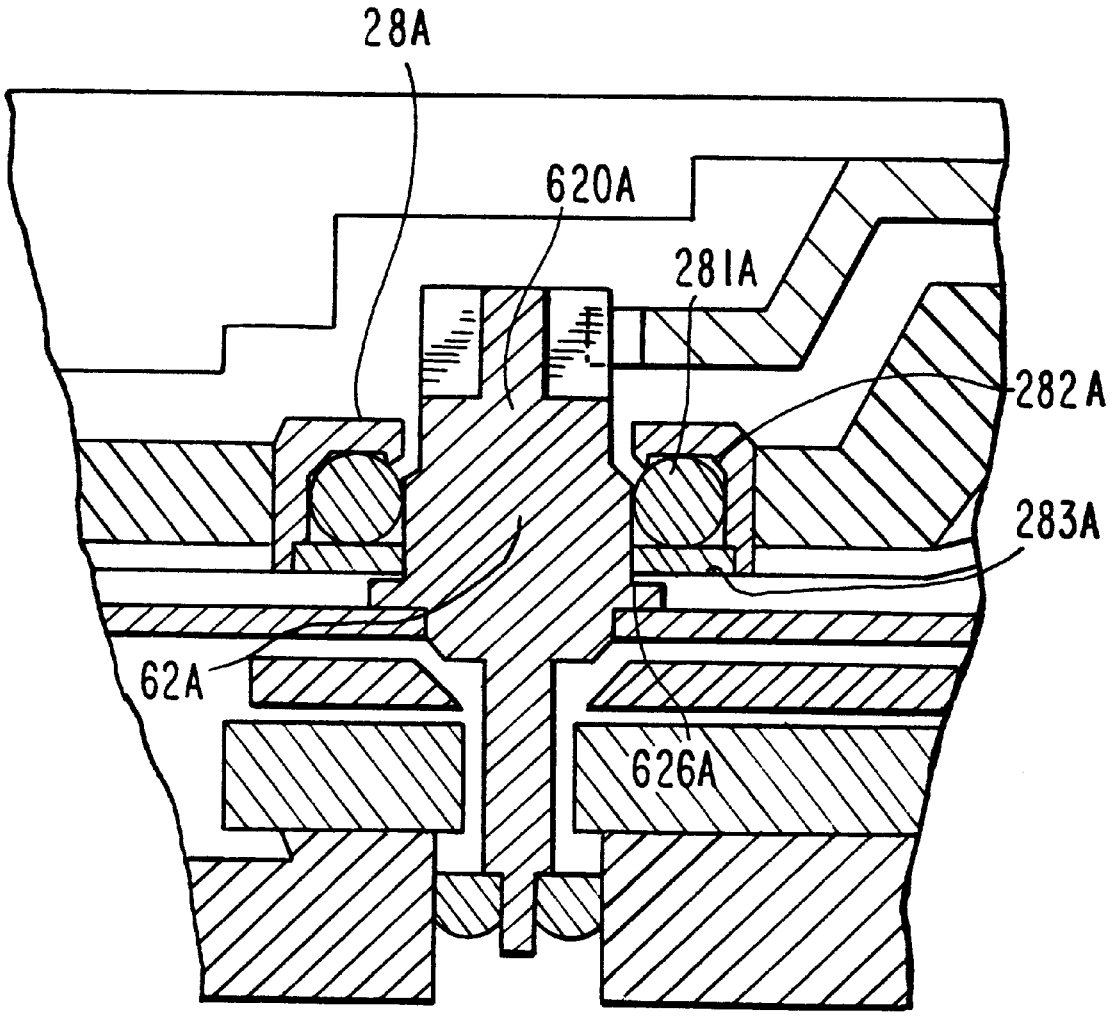
FIG.11 (PRIOR ART)
FIG. 11 is an explanatory view showing a conventional bearing structure.

FIG. 8 is a vertical sectional view of the watch wheel train and thereabout assembled in the electronic watch with hands of this embodiment, FIG. 9(A) is a vertical sectional view of the dynamo wheel train and thereabout assembled in the electronic watch with hands, FIG. 9(B) is an enlarged view of a bearing portion supporting the rotational shaft of the dynamo rotor, and FIG. 10 is a vertical sectional view of the small-sized dynamo and thereabout assembled in the electronic watch with hands.

As shown in FIG. 8, the oscillating weight 25 is fixed in place by the oscillating weight fixing screw 250 through a ball bearing 27 which is in turn fixed to the oscillating weight support 26. A wheel train bridge 80 is disposed between the ball bearing 27 and the main plate 200. One axial ends of rotational shafts 530, 510 of the third wheel 53 and the fifth wheel 51 are supported through hole jewels 531, 511 in holes 801, 802 formed in the wheel train bridge 80, respectively. The other axial ends of the rotational shafts 530, 510 of the third wheel 53 and the fifth wheel 51 are supported through hole jewels 532, 512 in holes 201, 202 formed in the main plate 200, respectively.

An outer peripheral portion of the hour wheel 56 is extended outward to a position overlapping the hole jewels 532, 512 for the third wheel 53 and the fifth wheel 51. The hour wheel 56 has opposite end surfaces shaped such that one of the end surfaces on which the hour hand locates is cut to hollow slightly in its inner peripheral portion 561, and the other end surface is cut to hollow slightly in its outer peripheral portion 562. This structure surely defines a gap G1 between the hour wheel 56 and the hole jewels 532, 512 for holding a lubricant in place.

A dial 3 of the watch is layered on the main plate 200. Holes 301 are formed in the dial 3 so that the rotational shaft of each train wheel can penetrate the dial 3 through the corresponding hole.

The dial 3 is arranged to extend along one of the end surfaces of the hour wheel 56 on which the hour hand locates. Because the inner peripheral portion 561 of the hour wheel 56 is cut to hollow slightly in the one end surface on which the hour hand locates, a conical plate spring 303 can be interposed between the inner peripheral portion 561 of the hour wheel 56 and the dial 3. Thus, by fitting one piece of conical plate spring 303 over the hour wheel 56 to position between the hour wheel 56 and the dial 3, it is possible to keep the hour wheel 56 and the dial 3 away from each other by a distance represented by a gap G2 in the inner peripheral portion 561 of the hour wheel 56. Accordingly, even if drilling the hole 301 in the dial 3 cause burrs (warped edges) along the hole circumference projecting toward a gear portion of the hour wheel 56, the burrs would not impede the rotation of the hour wheel 56. Additionally, since the gap G2 is definitely maintained by the presence of the conical plate spring 303 and the hollowed inner peripheral portion 561 of the hour wheel 56, the spacing between the hour wheel 56 and the dial 3 can be set to a necessary minimum size. This also contributes to reducing the thickness of the electronic watch 1 with hands.

(Structure for Determining Fit Looseness of Dynamo Rotor Transmitting Wheel)

In a position offset from the center of the main plate 200, as shown in FIG. 9(A), the dynamo rotor transmitting wheel 62, which is one of the wheels making up the dynamo wheel train 60 and has the pinion 621 held in mesh with the oscillating weight wheel 61, is supported between the oscillating weight support 26 and the main plate 200. The rotational shaft 620 of the dynamo rotor transmitting wheel 62 is supported at its one axial end by a ball bearing 28 which is held in a hole 263 formed in the oscillating weight support 26.

The ball bearing 28 comprises a plurality of balls 281 arranged around the rotational shaft 620 and a ring-shaped frame 280 for accommodating the balls 281 therein. The frame 280 comprises a ring-shaped frame piece 282 for holding the balls 281 from two directions, and a retainer piece 283 positioned adjacent the frame piece 282 for cooperating with it to prevent the balls 281 from slipping off. On the other hand, the rotational shaft 620 of the dynamo rotor transmitting wheel 62 has a stepped portion 626 formed in opposite relation to the retainer piece 283. Here, the balls 281 are partly projecting out of a gap between an inner peripheral edge of the retainer piece 283 (inner peripheral edge of one of both end surfaces of the frame 280 on the side where the stepped portion 626 locates) and the rotational shaft 620, so that the balls come into abutment against the stepped portion 626.

In the bearing structure thus constructed, since the balls 281 are held in abutment against the circumferential surface of the rotational shaft 620, a lateral inclination of the rotational shaft 620 is completely prevented. Also, the rotational shaft 620 has a play in the vertical direction. Of the up and down directions, however, a displacement of the rotational shaft 620 in the direction of arrow D is also completely prevented, because the stepped portion 626 abuts against the balls 281 when the rotational shaft 620 tends to shift over a predetermined distance in the direction of arrow D. Thus, when the dynamo rotor transmitting wheel 62 is rotated upon the motion of the oscillating weight 25, the stepped portion 626 and the balls 28 contact with each other through rolling friction as opposed to sliding friction, and hence the load loss of the wheel train can be kept small. Accordingly, in the electronic watch 1 with hands of this embodiment, it is possible to determine fit looseness of the dynamo rotor transmitting wheel 62 with a simple structure and reduce the thickness of the electronic watch. Moreover, since the dynamo rotor transmitting wheel 62, one of the train wheels which is most easily subject to lateral pressure, undergoes relatively small friction in its bearing portion, the efficiency of power generation is increased.

Note that since a hole jewel 622 is fitted over the opposite axis end of the rotational shaft 620 of the dynamo rotor transmitting wheel 62 and is held in a hole 204 formed in the main plate 200, fit looseness of the dynamo rotor transmitting wheel 62 in the direction toward the main plate is determined by the hole jewel 622.

(Structure for Preventing Scattering of Lubricant)

Laterally of a gear portion 623 of the dynamo rotor transmitting wheel 62, there is positioned a wall 804 formed at the end of the wheel train bridge 80. More specifically, in this embodiment, a portion of the wheel train bridge 80 is formed into a wall which locates between the watch wheel train 50 and the dynamo wheel train 60 and serves to prevent scattering of a lubricant. Even with the dynamo rotor transmitting wheel 62 rotating at a high speed, therefore, the lubricant applied to the rotational shaft 620 and the gear portion 623 is prevented from scattering to the third wheel 53, etc. This means that abnormal motion in driving the hands, such as stop or delay of the third wheel 53, etc., due to viscosity of the lubricant is an unlikely occurrence, and power consumed to compensate for any such abnormal motion in driving the hands can be reduced. In addition, since scattering of the lubricant is prevented by utilizing a portion of the train wheel bridge 80 which has been conventionally used in existing electronic watches, the thickness of the electronic watch 1 with hands can be reduced. Further, because no lubricant scatters to the surroundings, the parts can be arranged with narrower gaps between them. Correspondingly, a larger space for installation of the parts can be ensured, which also contributes to reducing the thickness of the electronic watch 1 with hands.

Laterally of the dynamo rotor transmitting wheel 62, the dynamo rotor 21 having the pinion 210 held in mesh with the gear portion 623 of the dynamo rotor transmitting wheel 62 is supported between the oscillating weight support 26 and the main plate 200.

A hole jewel 212 is fitted over one axial end of a rotational shaft 211 of the dynamo rotor 21. The hole jewel 212 is held in a hole 266 formed in the oscillating weight support 26 while it is fitted into a ring-shaped cap 213. Also, another hole jewel 214 is fitted over the other axial end of the rotational shaft 211 of the dynamo rotor 21. The hole jewel 214 is held in a hole 205 formed in the main plate 200 while it is fitted into a ring-shaped cap 215.

In this embodiment, the bearing portions using the hole jewels 212, 214 and the caps 213, 215 have the same structure. A description, therefore, is set forth, primarily directed to the bearing portion using the hole jewel 214 and the cap 215, with reference to FIG. 9(B).

In the illustrated bearing portion, the cap 215 not only covers the lateral side of the hole jewel 214, but also partly covers one end surface 216 of the hole jewel 214, which faces the dynamo rotor 21, from the outer side. Accordingly, an annular slot G3 for holding a lubricant between an inner peripheral surface of the cap 215 and an outer circumferential surface of the rotational shaft 211 is defined in a position corresponding to an inner portion of the end surface 216 of the hole jewel 214. The annular slot G3 has an opening width in the range of, e.g., about 40 m to about 100 m. Further, the annular slot G3 has a relatively large depth almost equal to the thickness of the cap 215. Even with the dynamo rotor 21 rotating at a high speed, therefore, the lubricant is surely prevented from spilling out of the annular slot G3 and scattering to the surroundings. As a result, the spacing between the adjacent parts can be narrowed and the thickness of the electronic watch 1 with hands can be reduced.

Moreover, the lubricant tends to scatter most easily from the bearing portion of the dynamo rotor 21 which is rotated at a maximum speed among the train wheels. In this embodiment, however, since the rotational shaft 211 of the dynamo rotor 21 is supported by the above-stated bearing structure, scattering of the lubricant can be effectively prevented.

Here, the cap 215 and the hole jewel 214 are formed as separate parts and assembled such that the hole jewel 214 is fitted into the cap 215. To prevent the lubricant from permeating into the space between the hole jewel 214 and the cap 215 and spreading further from there, this embodiment is practiced by immersing an assembly of the hole jewel 214 and the cap 215 fitted to each other in a treatment solution so that all the surfaces of the hole jewel 214 and the cap 215 are subject to surface treatment for preventing spread of the lubricant. Specifically, a fluorine-base coating is dissolved in a fluorine-base solvent to prepare a treatment solution, and the assembly of the hole jewel 214 and the cap 215 fitted to each other is immersed in the treatment solution. After the immersion, the assembly is dried to remove the solvent. As a result, a thin layer of the fluorine-base coating is formed all over the surfaces of the hole jewel 214 and the cap 215. Because the thin layer of the fluorine-base coating formed by the surface treatment serves to repel the lubricant, the lubricant is prevented from permeating into the space between the hole jewel 214 and the cap 215 and spreading further from there.

For the purpose of effectively conducting the above-mentioned surface treatment, in this embodiment, a gap 222 of predetermined size is positively maintained between the cap 215 and the end surface 216 of the hole jewel 214. The presence of the gap 222 enables the treatment solution to enter the space between the cap 215 and the hole jewel 214 so sufficiently that the surface treatment for preventing spread of a lubricant can be surely applied to all over the surfaces of the cap 215 and the hole jewel 214. Therefore, the lubricant maintained in the lubricant holding annular slot G3 will not spread through between the cap 215 and the hole jewel 214. For ensuring the gap 222, in this embodiment, bosses 219 are projected on the cap 215 to determine a depth of fitting resulted when the hole jewel 214 is fitted into the cap 215. Thus, by simply fitting the hole jewel 214 into the cap 215, it is possible to surely provide the gap 222 corresponding to the height of the bosses 219. The size of the gap 222 is about 10 m, for example, taking into account the coating layer of about 1 m formed by the surface treatment and the accuracy of machining.

In this embodiment, the rotational shaft 211 has a conical portion 217 formed in its outer circumferential surface near each of both the axial ends supported by the hole jewels 212, 214 such that the diameter of the rotational shaft 211 increases gradually in the conical portion 217 toward the portion where the lubricant holding annular slot G3 is defined. Therefore, even if the lubricant spills and adheres onto the rotational shaft 211, the lubricant adhering onto the conical portion 217 is forced to move toward a larger diameter end of the conical portion 217 (i.e., toward the lubricant holding annular slot G3) under an influence of centrifugal force when the rotational shaft 211 is rotated. As a result, the spilled lubricant is returned to the lubricant holding annular slot G3 and is surely prevented from scattering to the surroundings.

Furthermore, steps 218 (looseness eliminating steps) projecting in opposite relation to the hole jewels 212, 214 are formed on the outer circumferential surface of the rotational shaft 211. Therefore, if the rotational shaft 211 is shifted in the axial direction, the step 218 comes into abutment against the inner end surface of each of the hole jewels 212, 214, thereby preventing a further shift of the rotational shaft 211. Here, the position at which the step 218 is formed on the outer circumferential surface of the rotational shaft 211, and the depth of the annular slot G3 (the thickness of the cap 215 defining the annular slot G3) are set so that the step 218 is always located within the lubricant holding annular slot G3 even when the rotational shaft 211 is axially shifted in either direction. With this construction, even if the lubricant is forced to scatter out of the annular slot G3, the outgoing lubricant is blocked by the step 218 of the rotational shaft 211 and hence scattering of the lubricant is more surely prevented. In this embodiment, for example, the depth of the annular slot G3 is set to about 100 m or above. Note that the depth of the annular slot G3 being as small as possible is advantageous in reducing the thickness of the electronic watch with hands, the depth of the annular slot G3 is set to a necessary minimum value within the range sufficient to prevent scattering of the lubricant.

Further, a lubricant injection recess 220 is formed in the outer end surface of each of the hole jewels 212, 214. Accordingly, when the lubricant is injected and kept in the recess 220, the injected lubricant permeates into openings of the hole jewel 214 and then accumulates in the lubricant holding annular slot G3. Here, the recess 220 has an outer diameter D larger than an outer diameter d of the lubricant holding annular slot G3, and also has an inner volume larger than that of the annular slot G3. This ensures that the amounts of the lubricant held by the annular slot G3 and the lubricant injection recess 220, respectively, are balanced.

(Connecting Structure between Dynamo Stator and Magnetic Core)

As shown in FIG. 10, the dynamo rotor 21 is located in surrounded relation by the dynamo stator 22. The dynamo stator 22 is connected to the magnetic core 24 of the small-sized dynamo 20. The magnetic core 24 comprises a lower magnetic core 241 positioned on the main plate 200 and an upper magnetic core 242 placed over the lower magnetic core 241. Of these two layered magnetic cores, the lower magnetic core 241 is connected to the dynamo stator 22 through a core connecting screw 246 and a screw seat 247.

In the connecting portion between the magnetic core 24 and the dynamo stator 22, the lower magnetic core 241 is extended horizontally beyond the end of the outer magnetic core 242 toward the dynamo stator 22. The end of the dynamo stator 22 is bent to provide a joint end 220 which is positioned to lie over an extended portion 240 of the lower magnetic core 241. Also, the joint end 220 is machined to have a thinner wall portion 221 in an area where it is fastened by the core connecting screw 246. Thus, the thickness of the connecting portion between the magnetic core 24 and the dynamo stator 22 can be kept small because it is given by the sum of the thickness of the lower magnetic core 241 and the thinner wall portion 221 of the joint end 220 of the dynamo stator 22.

As described above, the connecting portion between the dynamo stator 22 and the magnetic core 24 has such a sectional structure that the main plate 200, the magnetic core 24 and the dynamo stator 24 are layered one above another in the order named. Also, in the sectional structure, the joint end 220 (joint portion) of the dynamo stator 22 has an upper surface 222 and a lower surface 223 which are both positioned between an upper surface 224 and a lower surface 225 of the dynamo stator 22 arranged in surrounding relation to the dynamo rotor 211. Further, the upper surface 222 of the joint end 220 is positioned at a lower level than an upper surface 211 of the magnet of the dynamo rotor 21. Therefore, the electronic watch 1 with hands according to this embodiment can have a reduced thickness.

Additionally, the dynamo stator 22 is machined into the thinner wall portion 221 only in the joint portion thereof with the magnetic core 24, and the other portion of the dynamo stator 22 still remains as a thicker wall portion. Therefore, the extended portion 240 of the lower magnetic core 241 and the thicker wall portion of the dynamo stator 22 can be brought into contact with each other in an area around the joint portion of the dynamo stator 22. That structure prevents a reduction in intensity of the allowable magnetic flux in the area around the joint portion of the dynamo stator 22, and keeps the magnetic flux passing through the magnetic circuit of the small-sized dynamo 20 from leaking out from there. Also, that structure eliminates a need of partly reducing the thickness of the main plate 200 with the intent of reducing the thickness of the joint portion of the dynamo stator 22. As a result, the strength of the main plate 200 can be kept high.

(Other embodiments)

In the above embodiment, the invention relating to a ball bearing for a rotational shaft of a gear has been explained in connection with the bearing structure for the dynamo rotor transmitting wheel 62 of the dynamo wheel train 60. However, the bearing structure may also be applied to the rotational shaft of any other gear or the like. While the bearing structure of the above embodiment has been applied to only one axial end of the rotational shaft 620 of the dynamo rotor transmitting wheel 62, it may also be applied to both the axial ends of the rotational shaft 620.

In the above embodiment, the bearing portion for the rotational shaft has been explained as being made up of the hole jewel 214 and the cap 215 separate from each other. But the hole jewel 214 and the cap 215 may be constructed respectively as a hole jewel portion and a cap portion of one unitary component. Alternatively, the hole jewel 214 and the cap 215 may be constructed integrally with the base 2 to serve as a hole jewel portion and a cap portion, respectively. This integration of the hole jewel 214 and the cap 215 into one unitary component contributes to reducing the production cost of the electronic watch with hands.

As described above, the electronic watch according to the first aspect of the present invention is featured in using a bearing portion comprised of a hole jewel portion supporting an axial end of a rotational shaft, and a ring-shaped cap portion covering one end surface of the hole jewel portion from the outer side to define a lubricant holding annular slot between the cap portion and an outer circumferential surface of the rotational shaft. With the present invention, therefore, a lubricant applied to between the rotational shaft and the hole jewel portion is held in the lubricant holding annular slot and is prevented from scattering to the surroundings even under rotation of the rotational shaft. Consequently, gaps between adjacent parts can be narrowed and a thinner electronic watch can be provided.

In the electronic watch according to the second aspect of the present invention, since the position of the rotational shaft is restricted in two directions by the balls of a ball bearing, the rotational shaft can be supported through a rolling bearing in any of the two directions. This results in low friction resistance being exerted on the rotational shaft during its rotation. Additionally, such a bearing structure is achieved just by partly improving a ball bearing structure, and hence has a size remaining small. As a result, a thinner electronic watch can be provided.

The electronic watch according to the third aspect of the present invention is featured in that a oscillating weight is constructed of a thinner wall portion and a thicker wall portion to increase weight unbalance of the oscillating weight, and necessary members are arranged in an optimum state, separately, in respective rotating areas of the thinner wall portion and the thicker wall portion of the oscillating weight. With the present invention, therefore, a narrow gap defined in the rotating area of the thicker wall portion of the oscillating weight can also be utilized effectively and hence a thinner electronic watch can be provided.

What is claimed is:

1. An electronic watch, comprising:

a base on which is mounted:

a dynamo including a dynamo wheel train for transmitting external force to a dynamo rotor;

a secondary power supply for storing electric energy generated by said dynamo;

a circuit section supplied with power from said secondary power supply at least one of a rotational shaft of said dynamo rotor and a rotational shaft of said dynamo wheel train being supported at an axial end thereof by a bearing comprising a plurality of balls, said axial end of said rotational shaft comprising a circumferential surface parallel with the axis of rotation of said rotational shaft and a step portion having a first surface projecting radially from said circumferential surface of said axial end and a second surface, an outside corner portion defined where the first surface meets the second surface, and said balls abutting said circumferential surface of said axial end of said rotational shaft in the radial direction so as to restrict a lateral inclination of said rotational shaft and said balls abutting said rotational shaft at said outside corner of said step portion so as to restrict the movement of said rotational shaft in the axial direction.

2. An electronic watch according to claim 1, wherein said bearing supports a dynamo rotor transmitting wheel of said dynamo wheel train, said dynamo rotor transmitting wheel being operatively connected to an oscillating weight wheel which is rotated upon receiving an external force.

3. An electronic watch according to claim 1, wherein said bearing comprises a plurality of balls arranged around said rotational shaft and a ring-shaped frame for retaining said balls therein, and said balls are partly projecting out of a gap between an inner edge of one of opposite end surfaces of said ring-shaped frame on the side where said stepped portion is formed and said rotational shaft, so that said balls come into abutment against said stepped portion.

4. An electronic watch according to claim 2, wherein said bearing comprises a plurality of balls arranged around said rotational shaft and a ring-shaped frame for retaining said balls therein, and said balls are partly projecting out of a gap between an inner edge of one of opposite end surfaces of said ring-shaped frame on the side where said stepped portion is formed and said rotational shaft, so that said balls come into abutment against said stepped portion.

5. An electronic watch according to claim 1, wherein said watch wheel train includes an hour wheel coupled to an hour hand; and said hour wheel having opposite end surfaces machined such that one end surface on a side where said hour hand is located is cut to hollow slightly in an inner peripheral portion thereof, and an other end surface opposite said side where said hour hand is located is cut to hollow slightly in an outer peripheral portion thereof.

6. An electronic watch according to claim 1, wherein a wall for preventing scattering of a lubricant is formed between said watch wheel train and said dynamo wheel train by a portion of a wheel train bridge supporting said watch wheel train.

7. An electronic watch according to claim 1, further comprising:

a connecting portion between said dynamo stator and a dynamo magnetic core of said dynamo, said connecting portion having a sectional structure upon which is layered in a stacked arrangement, a main plate, said dynamo magnetic core and said dynamo stator; and respective portions of said dynamo stator and said dynamo magnetic core each jointly have upper and lower surfaces which are both positioned between upper and lower surfaces of said dynamo stator and arranged in surrounding relation to said dynamo rotor, the upper surface of said respective portions being positioned at a lower level than an upper surface of a magnet of said dynamo rotor.

* * * * *